US011714445B2

(12) United States Patent
Boulestin

(10) Patent No.: US 11,714,445 B2
(45) Date of Patent: Aug. 1, 2023

(54) CURRENT MIRROR CIRCUIT

(71) Applicant: STMicroelectronics (Grenoble 2) SAS, Grenoble (FR)

(72) Inventor: Renald Boulestin, Grenoble (FR)

(73) Assignee: STMicroelectronics (Grenoble 2) SAS, Grenoble (FR)

( * ) Notice: Subject to any disclaimer, the term of this patent is extended or adjusted under 35 U.S.C. 154(b) by 0 days.

(21) Appl. No.: 17/809,793

(22) Filed: Jun. 29, 2022

(65) Prior Publication Data

US 2023/0004183 A1 Jan. 5, 2023

(30) Foreign Application Priority Data

Jun. 30, 2021 (FR) ..... 2107030

(51) Int. Cl.
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS 6,285,615 B1 * 9/2001 Quader ..... G11C 11/5621 365/208
6,388,508 B1 * 5/2002 Kawasumi ..... G05F 3/262 327/543
6,407,620 B1 * 6/2002 Hirayama ..... G05F 3/265 323/315
6,462,527 B1 * 10/2002 Maneatis ..... H03L 7/18 323/315
6,847,081 B2 * 1/2005 Letavic ..... H01L 29/7824 257/487
6,985,028 B2 * 1/2006 Lee ..... G05F 3/262 327/543
6,995,612 B1 * 2/2006 Chen ..... G05F 3/262 330/288
7,248,100 B2 * 7/2007 Koizumi ..... G05F 3/262 327/543
7,408,414 B2 * 8/2008 North ..... H03F 3/45475 330/297
8,471,631 B2 * 6/2013 Tanaka ..... H03F 3/193 330/288
9,894,309 B2 * 2/2018 Yun ..... H03K 4/026
11,309,901 B2 * 4/2022 Påhlsson ..... H03L 7/091
2005/0110666 A1 * 5/2005 Date ..... G09G 3/3283 341/144

OTHER PUBLICATIONS

All About Electronics, Learn Everything about Electronics, https://www.allaboutelectronics.org/what-is-current-mirror-mosfet-current-mirror-explained/, Feb. 2, 2021, 13 pages.

* cited by examiner

*Primary Examiner* — Thomas J. Hiltunen
(74) *Attorney, Agent, or Firm* — Slater Matsil, LLP

(57) ABSTRACT

In an embodiment an electronic device includes a first MOS-type transistor and a second MOS-type transistor connected as current mirrors, wherein the first transistor is diode connected and a first circuit configured to provide a first current equal to a first gate current of the first transistor multiplied by a size ratio of the first and second transistors.

20 Claims, 6 Drawing Sheets

CURRENT MIRROR CIRCUIT

CROSS-REFERENCE TO RELATED APPLICATIONS

This application claims the benefit of French Application No. 2107030, filed on Jun. 30, 2021, which application is hereby incorporated herein by reference.

TECHNICAL FIELD

The present disclosure generally relates to electronic circuits and systems. More particularly, the present disclosure relates to electronic circuits that make it possible to copy a current, and more specifically to current mirror circuits.

BACKGROUND

There are a plurality of electronic circuits capable of performing elementary operations used in more complex electronic devices. Of the most common elementary operations to perform, current mirroring is very useful.

A current mirror circuit, or current mirror, is an electronic circuit that makes it possible to copy a current flowing through a first conductor into a second conductor.

SUMMARY

Embodiments provide current mirror circuits.

Embodiments provide a current mirror circuit that can copy a current more accurately.

Various embodiments address all or some of the drawbacks of known current mirror circuits.

One embodiment provides an electronic device comprising a first MOS type of transistor and a second MOS type of transistor connected as a current mirror, the first transistor being diode connected, and a first circuit adapted to provide a first current equal to a first gate current of the first transistor multiplied by the size ratio of the first and second transistors.

According to one embodiment, said first circuit is connected to a first node, interconnecting the first and second transistor gates, and to a second node, interconnecting a first conduction terminal of the first transistor and a first conduction terminal of the second transistor, and said first circuit supplies said first current to a second conduction terminal of the second transistor.

According to one embodiment, the first and second transistors are P-type MOS transistors.

According to one embodiment, said first circuit comprises a first module, adapted to isolate the first gate current and a first current mirror.

According to one embodiment, the first current mirror comprises third and fourth MOS transistors, the third transistor being diode connected, wherein the second gate currents of the second and third transistors are negligible in relation to the first gate current.

According to one embodiment, the third and fourth transistors are PMOS transistors having a double oxide layer.

According to one embodiment, the third and fourth transistors have a size ratio equal to the size ratio of the first and second transistors.

According to one embodiment, the first current mirror comprises fifth and sixth transistors, the fifth transistor being diode connected, and wherein a third gate current of the fifth transistor is proportional to the first gate current.

According to one embodiment, the third gate current is equal to half of the first gate current, and the size ratio of the fifth and sixth transistors is equal to twice the size ratio of the first and second transistors.

According to one embodiment, said first circuit comprises K second circuits arranged in a cascade, with K being a relative integer and each being adapted to isolate the parasitic current from the preceding circuit.

According to one embodiment, K is equal to 2 or 3.

According to one embodiment, a second circuit ranked i, with i varying from 1 to K, comprises an input node connected to an output node of the second circuit ranked i−1, a first output node connected to, and a second output node connected to the second conduction terminal of the second transistor.

According to one embodiment, each of the second circuits comprises a second current mirror comprising seventh MOS transistors of the same dimensions, a third current mirror comprising eighth MOS transistors whose size ratio is equal to the size ratio of the first and second transistors and a second module, adapted to isolate a parasitic current from another of said second circuits.

According to one embodiment, the second module is connected to the input nodes of the second circuits ranked between 1 and i−2, and to the interconnection node of the gates of the first and second transistors.

According to one embodiment, the second and third current mirrors share a same, ninth diode connected transistor.

BRIEF DESCRIPTION OF THE DRAWINGS

The foregoing features and advantages, as well as others, will be described in detail in the following description of specific embodiments given by way of illustration and not limiting with reference to the accompanying drawings, in which.

DETAILED DESCRIPTION OF ILLUSTRATIVE EMBODIMENTS

Like features have been designated by like references in the various figures. In particular, the structural and/or functional features that are common among the various embodiments may have the same references and may dispose identical structural, dimensional and material properties.

For the sake of clarity, only the operations and elements that are useful for an understanding of the embodiments described herein have been illustrated and described in detail.

Unless indicated otherwise, when reference is made to two elements connected together, this signifies a direct connection without any intermediate elements other than conductors, and when reference is made to two elements coupled together, this signifies that these two elements can be connected or they can be coupled via one or more other elements.

In the following disclosure, unless indicated otherwise, when reference is made to absolute positional qualifiers, such as the terms "front", "back", "top", "bottom", "left", "right", etc., or to relative positional qualifiers, such as the terms "above", "below", "higher", "lower", etc., or to qualifiers of orientation, such as "horizontal", "vertical", etc., reference is made to the orientation shown in the figures.

Unless specified otherwise, the expressions "around", "approximately", "substantially" and "in the order of" signify within 10%, and preferably within 5%.

In the following description a current mirror circuit is referred to as a current mirror.

Figure 1:
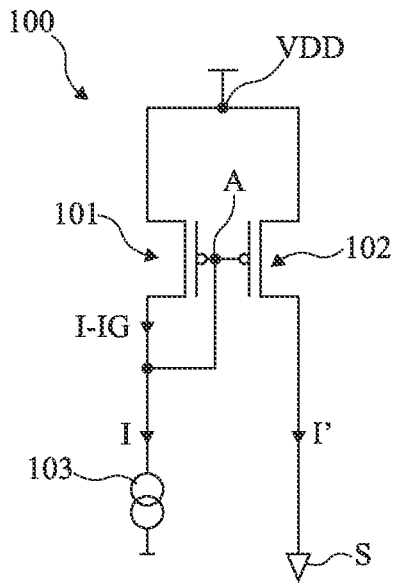
FIG. 1 shows a current mirror circuit comprising PMOS transistors.

FIG. 1 is an electrical diagram of a current mirror 100.

The current mirror 100 comprises two transistors 101 and 102. The transistors 101 and 102 are gate insulated field effect transistors, more commonly referred to as metal oxide semiconductor field effect transistors (MOSFET), or MOS transistors. The transistors 101 and 102 are transistors of the same type. According to one example, the transistors 101 and 102 are P-channel MOS transistors, also known as PMOS transistors. In FIG. 1, the transistors 101 and 102 are PMOS transistors. According to one variant, the transistors 101 and 102 can be N-channel MOS transistors, or NMOS transistors; the person skilled in the art will know how to adapt the device connections in this case.

The transistors 101 and 102 are arranged head-to-tail and are current mirrored. In other words, the transistors 101 and 102 have their gates linked, preferably connected or interconnected, to an interconnection node A. In addition, the transistor 101 has its gate linked, preferably connected or interconnected, to one of its conduction terminals. The transistor 101 is said to be diode connected. More particularly, when the transistor 101 is a PMOS-type transistor, the transistor 101 has its gate linked, preferably connected or interconnected, to its drain.

The transistor 101 further has one of its conduction terminals interconnected to the same conduction terminal of the transistor 102. More particularly, when the transistors 101 and 102 are PMOS-type transistors, the sources of the transistors 101 and 102 are interconnected. The interconnection node of the conduction terminals of the transistors 101 and 102 is denoted VDD. According to one example, the interconnection node VDD receives a supply potential VDD, such as a potential that is higher than the ground.

At its conduction terminal, connected to its gate, i.e. its drain, the transistor 101 receives a current I, to be copied. In FIG. 1, the current I is supplied by a current source 103, for example, but in practice the drain of the transistor 101 can receive the current I from any electronic device node. Conventionally, the current I flows from the drain of the transistor 101 to the current source 103.

The transistor 102 provides a copied current I' at its free conduction terminal, i.e. its drain in FIG. 1. The current I' flows from the drain of the transistor 102 to an output node S of the current mirror 100. Theoretically, the current I' is proportional to the current I, with a proportionality coefficient M defined by the ratio of the gate widths and gate lengths of the transistors 101 and 102. If the transistors 101 and 102 are identical, then theoretically the current I' is equal to the current I. However, in practice, the current I' additionally depends on the gate current IG of the transistor 101, according to the following relationship:

$$I'=M*(I-IG)$$

It may be that the gate current IG has an order of magnitude that is non-negligible in relation to or even comparable to the current I, and thus causes a resulting loss of current at the current mirror output. The miniaturization of transistors tends to increase the occurrence of this phenomenon. Indeed, the smaller a transistor is, the thinner its gate oxide layer is, and the more likely it is to let electrons pass through, by tunneling effect. This can happen for transistors with a gate length of the order of 3 nm, 5 nm, 7 nm, or even 16 nm, and of a relatively small gate thickness, i.e. a thickness of between 1 nm and 1 mm. The following embodiments are intended to overcome this problem.

Figure 2:
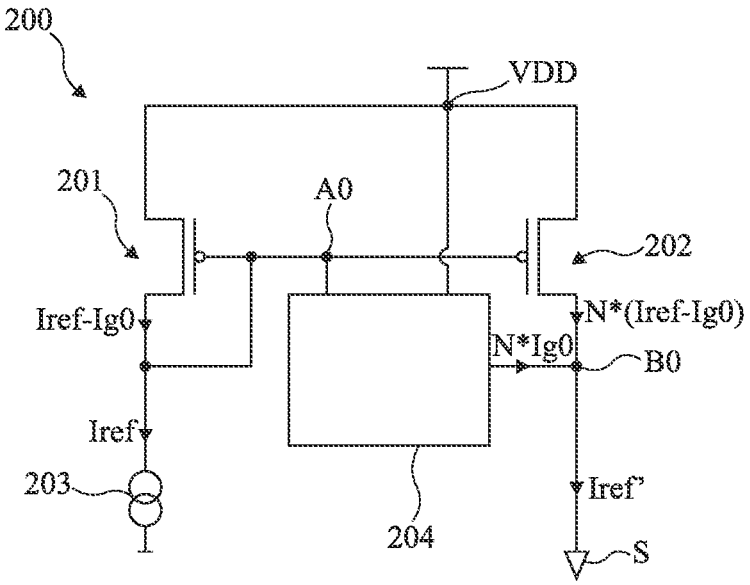
FIG. 2 shows one embodiment of an electronic device, schematically and partially in block form.

FIG. 2 shows an electrical diagram of one embodiment of an electronic device 200, schematically and in block form. The electronic device 200 is a current mirror circuit, or current mirror, according to one embodiment.

The device 200 comprises two transistors 201 and 202. The transistors 201 and 202 are MOS transistors. The transistors 201 and 202 are transistors of the same type. The gate width-to-length ratio of the transistors 201 and 202 is denoted N. According to one example, in FIG. 2, the transistors 201 and 202 are PMOS transistors. In a variant, the transistors 201 and 202 may be NMOS transistors, and the person skilled in the art will know how to adapt the connections of the current mirror 200 in this case.

The transistors 201 and 202 are arranged like the transistors 101 and 102 of the current mirror 100 described in connection with FIG. 1. In other words, the transistors 201 and 202 are current mirror mounted, and the transistor 201 is diode connected. The gate interconnection node of the transistors 201 and 202 is denoted A0, and the source interconnection node of the transistors 201 and 202 is still denoted VDD. As before, the node VDD may receive a supply potential.

As in FIG. 1, the transistor 201 receives a current Iref from a current source 203, at its input node, corresponding to the drain of the transistor 201. The current Iref flows from the drain of the transistor 201 to the current source 203. The device 200 provides a copy of the current Iref, denoted Iref', at its output node S. The current Iref' flows from a node B0 to the output node S.

The device 200 further comprises a circuit 204 adapted to provide a current N*Ig0, at the node B0, equal to the gate current of the transistor 201 multiplied by the coefficient N, i.e. the gate current of the transistor 202. The circuit 204 is connected to the node A0 interconnecting the gates of the transistors 201 and 202, and to the node VDD.

The circuit 204 makes it possible to compensate for a parasitic current imposed by the current mirror formed by the transistors 201 and 202 corresponding to the gate current N*Ig0 causing the losses of the output current Iref of the device 200. The circuit 204 is described in more detail in connection with FIGS. 3 and 4.

More particularly, the current mirror formed by the transistors 201 and 202 makes it possible to provide a current, on the drain of the transistor 202, flowing from the drain of the transistor 202 to the node B0, and given by the following formula:

$$Iref'=N*(Iref-Ig0)$$

By using a nodal rule, it is then possible to determine that the current Iref is equal to the current Iref multiplied by the coefficient N.

Figure 3:
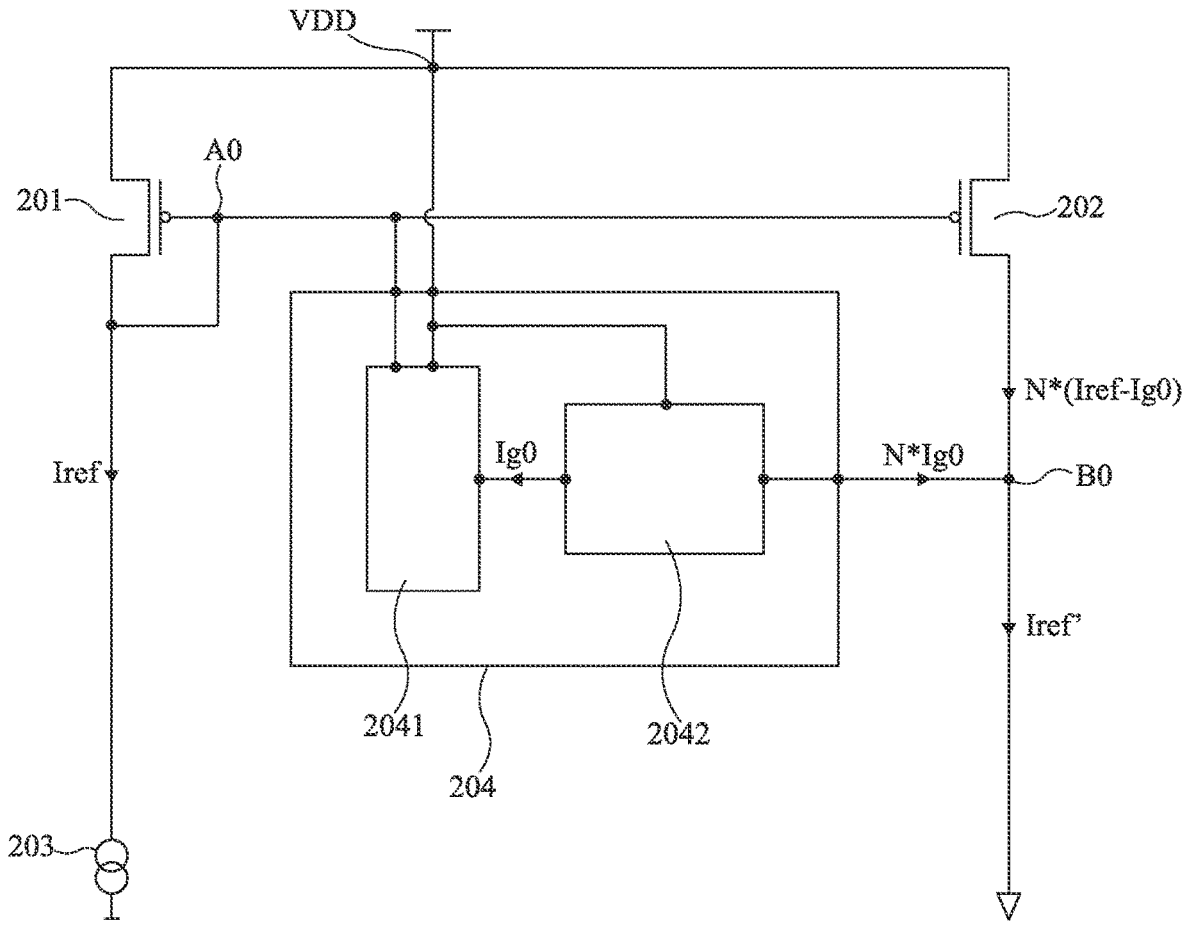
FIG. 3 shows the embodiment of FIG. 2 in more detail, schematically and partially in block form.

FIG. 3 shows schematically an electrical diagram of the device 200 described in relation to FIG. 2, in block form and in more detail.

The circuit 204 comprises at least two modules 2041 and 2042, arranged in series between nodes A0 and B0.

The module 2041 is a circuit adapted to isolate the gate current Ig0 of the transistor 201. The module 2041 is linked, preferably connected, to the nodes A0 and VDD. The module 2041 provides the current Ig0 as an output. Conventionally, the current Ig0 flows to the module 2041.

The module 2042 is a circuit adapted to multiply the gate current Ig0, isolated the by module 2041, by the coefficient N. The module 2042 is linked, preferably connected, to the node VDD, and receives the current Ig0 provided by the module 2041 as an input. The module 2042 provides the current N*Ig0 as an output, to the node B0. The current N*Ig0 flows from the module 2042 to the node B0.

Examples of the modules 2041 and 2042 are described in more detail in connection with FIG. 4.

Figure 4:
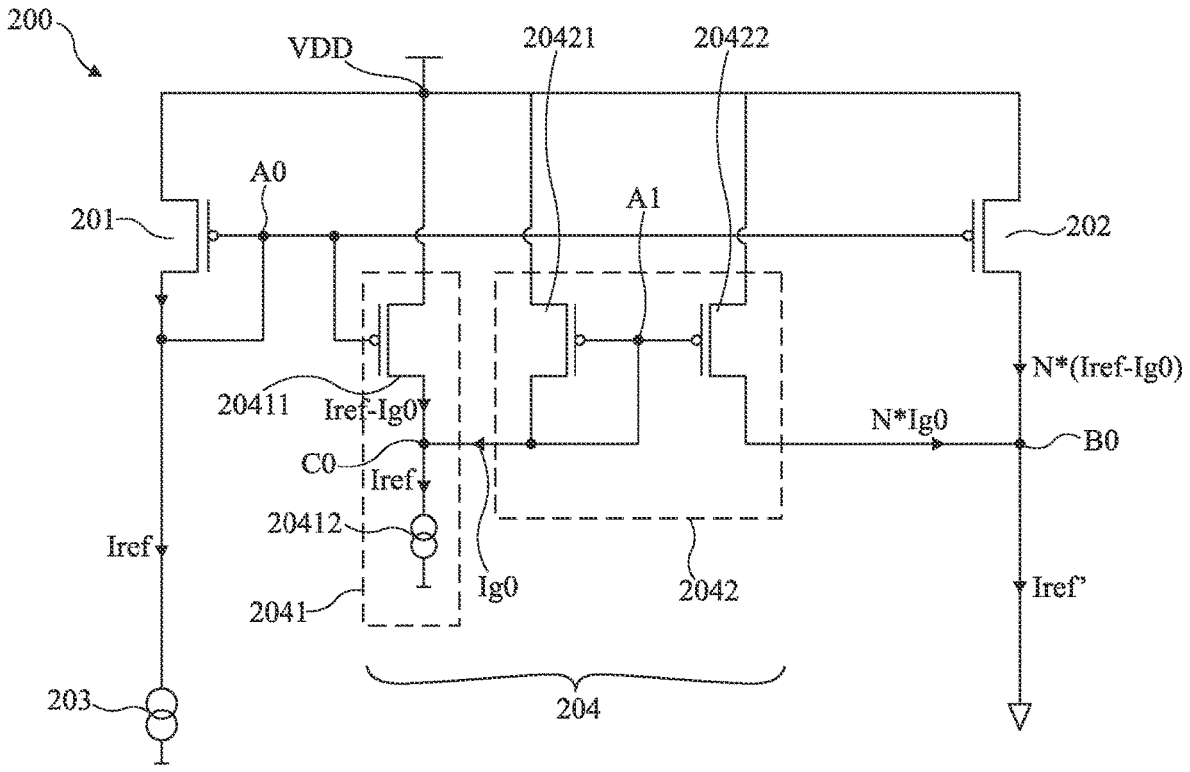
FIG. 4 shows the embodiment of FIG. 2 in even more detail, schematically and partially in block form.

FIG. 4 shows an electrical diagram of an example embodiment of implementation of the electrical device described in connection with FIGS. 2 and 3.

In the example shown in FIG. 4, the module 2041 comprises a transistor 20411 and a current source 20412.

The transistor 20411 is identical to the transistor 201. Thus, the transistor 20411 in FIG. 4 is a PMOS-type transistor of the same size as the transistor 201. The transistor 20411 is current-mirrored with the transistor 201. Thus, the gate of the transistor 20411 is linked, preferably connected or interconnected to the gate of the transistor 201, i.e. to the node A0, and the source of the transistor 20411 is linked, preferably connected or interconnected to the source of the transistor 201, i.e. to the node VDD. Thus, the current supplied to the drain of the transistor 201 is equal to the current Iref subtracted from the gate current Ig0 of the transistor 201, denoted Iref-Ig0. The current Iref-Ig0 flows from the drain of the transistor 20411 to a node C0.

The current source 20412 is similar, preferably identical, to the current source 203 and provides the current Iref. The current Iref flows to the current source 20412.

The node C0 is the output node of the module 2041. The output current is equal to the gate current Ig0 of the transistor 201. The current Ig0 flows to the output node C0 of the module 2041.

The module 2042 is a current mirror circuit, adapted to multiply the current Ig0 provided by the module 2041 by the coefficient N. The module 2042 comprises two current-mirrored transistors 20421 and 20422, with the transistor 20421 diode connected. The transistors 20421 and 20422 are transistors of the same type as the transistors 201 and 202, i.e. PMOS-type transistors. The gate interconnection node of the transistors 20421 and 20422 is denoted A1, and the source interconnection node of the transistors 20421 and 20422 is the node VDD. The current mirror input node, i.e. the drain of the transistor 20421, is linked, preferably connected, to the node C0. The current mirror output node, i.e. the drain of the transistor 20422, is linked, preferably connected, to the node B0.

The drain of the transistor 20421 receives the current Ig0 from the module 2041. The drain of the transistor 20422 outputs the current Ig0 multiplied by the coefficient N, noted N*Ig0. The current N*Ig0 flows from the drain of the transistor 20422 to the node B0.

Here, two embodiment are possible for obtaining the multiplication of the current Ig0 by the coefficient N.

According to a first embodiment, the transistors 20421 and 20422 are each chosen to have a negligible gate current in relation to the gate current Ig0. As an example, the transistors 20421 and 20422 are chosen to have smaller dimensions than the transistors 201 and 202. According to another example, the transistors 20421 and 20422 are transistors having a gate composed of two conventional gate stacks, i.e. having a double gate oxide layer. Further, the transistors 20421 and 20422 are chosen to have a coefficient equal to the coefficient N of the transistors 201 and 202. According to one example, in order to have a negligible gate current in relation to the gate current Ig0, the transistors 20421 and 20422 may be transistors having a double gate oxide layer. According to another example, the transistors 20421 and 20422 may be transistors having a gate width and/or length greater than that of the transistors 201 and 202.

According to a second embodiment, the transistor 20421 is chosen to have a gate current equal to half the gate current of the transistor 201, denoted 2*Ig0. In addition, the transistors 20421 and 20422 are chosen to have a ratio between gate widths equal to twice that of the transistors 201 and 202, denoted 2*N. Thus, the output current of the circuit 204 is given by the following formula:

$$2*N*(Ig0-\tfrac{1}{2}Ig0)=N*Ig0$$

Figure 5:
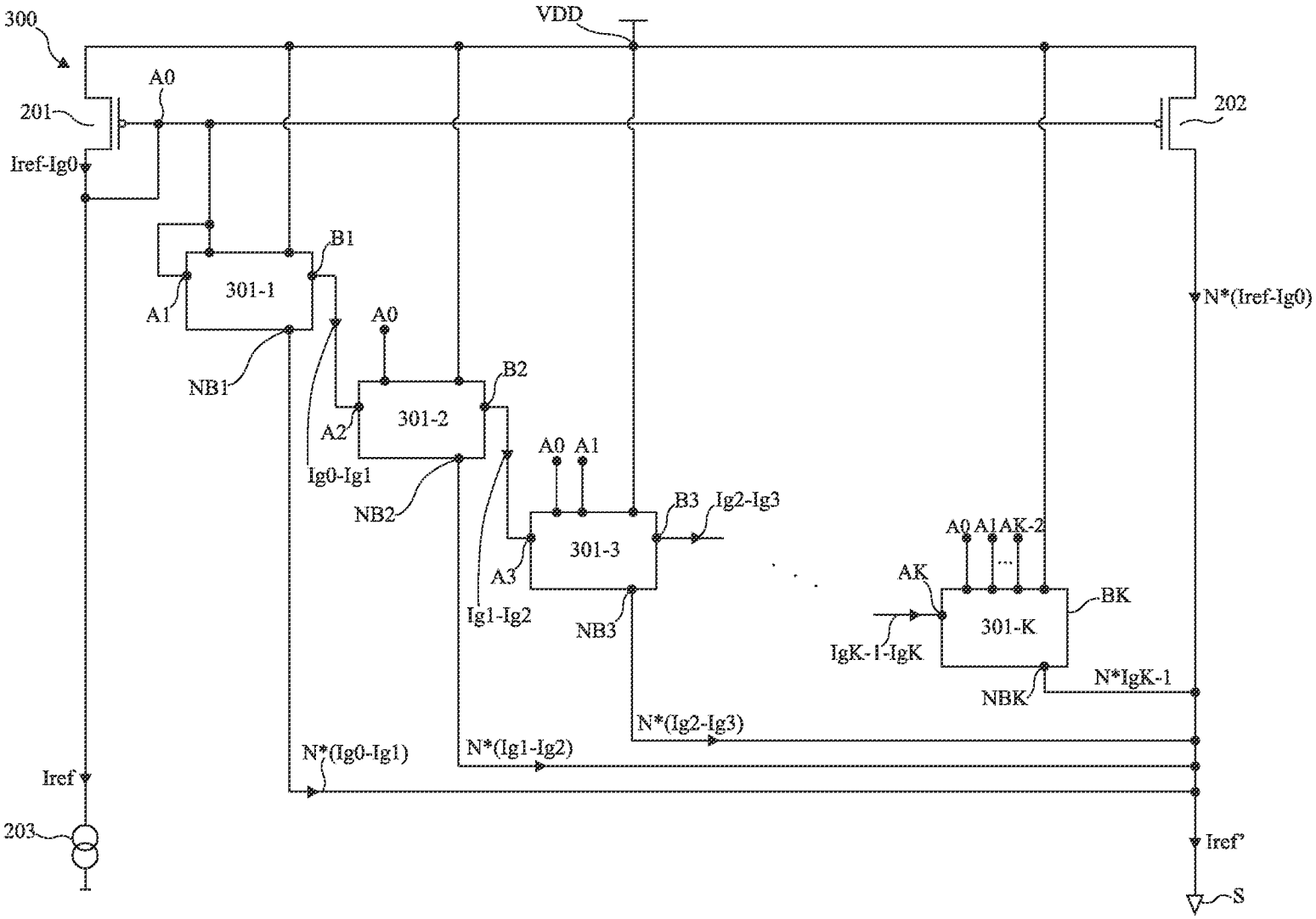
FIG. 5 shows another embodiment of an electronic device, schematically and partially in block form.

FIG. 5 shows another embodiment of an electronic device 300, schematically and in block form. The electronic device 300 is a current mirror circuit, or current mirror, according to one embodiment.

The device 300 is similar to the electronic device 200 described in connection with FIGS. 2, 3 and 4. The common elements of the devices 300 and 200 are not described again here; only their differences are highlighted.

Figure 8:
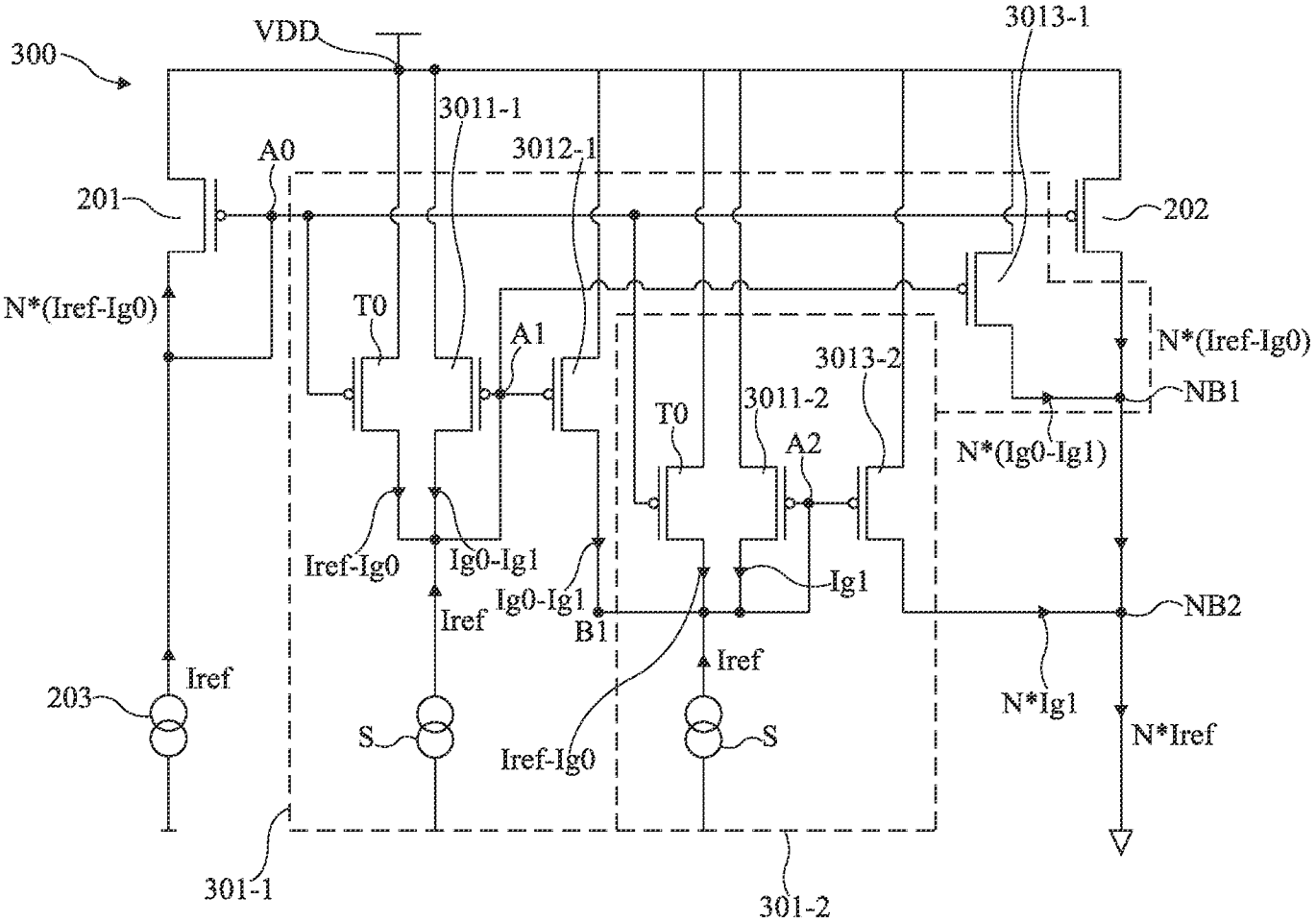
FIG. 8 shows in more detail an example of the embodiment of FIG. 5.

Like the device 200, the device 300 comprises a first current mirror formed by the transistors 201 and 202, receiving the current Iref supplied by the current source 203, and, replacing the circuit 204, further comprises a series of K circuits 301-I, with K and i being natural numbers and i varying from 1 to K, similar to the circuit 204 of the device 200. According to one example, K may be equal to one, two, or three. FIG. 8 illustrates the case of a device 300 in which K is equal to two.

Each circuit 301-*i* comprises an input node Ai and two output nodes Bi and NBi. Further, each circuit 301-*i* is linked, preferably connected, to the nodes VDD and A0, and to the nodes A1, A2, . . . Ai−2 of the preceding circuits 301-1, 301-2, . . . 301-*i*−2.

The circuits 301-*i* are cascaded. More particularly, each circuit 301-*i* has its input node Ai linked, preferably connected, to the output node Bi−1 of the preceding circuit 301-*i*−1. The output node NBi is linked, preferably connected, to the output node S of the device 300. The circuit 301-1 has its input node A1 connected to the node A0.

The circuit 301-1 has the role of isolating the gate current Igi from the current mirror formed by the transistors 201 and 202. Each circuit 301-*i* has the role of providing a current dependent on the parasitic current of the preceding circuit 301-*i*−1 and its own parasitic current. Thus, if each circuit 301-*i* has a parasitic current noted Igi, each circuit 301-*i* receives a current equal to (Igi−2)-(Igi−1) on its input node Ai, and supplies a current equal to (Igi−1)-(Igi) on its output node Bi.

The circuits 301-*i* also have the role of supplying a current equal to N*[(Igi−1)-(Igi)] on their output node NBi. This makes it possible to have an output current of the device 300 equal to the current Iref of the current source not taking into account the gate current Ig0 of the transistor 201.

The circuit 301-K is similar to the circuit 204 described in connection with FIG. 2 and provides the parasitic current of the circuit 301-K−1 multiplied by the coefficient N, noted N*IgK−1. According to one embodiment, the circuit 301-K may not comprise an output node BK.

One advantage of this embodiment is that it makes it possible to have a more accurate estimation of the gate current Ig0 of the transistor 201.

One example embodiment of the circuits 301-*i* is described in more detail in connection with FIGS. 6 and 7.

Figure 6:
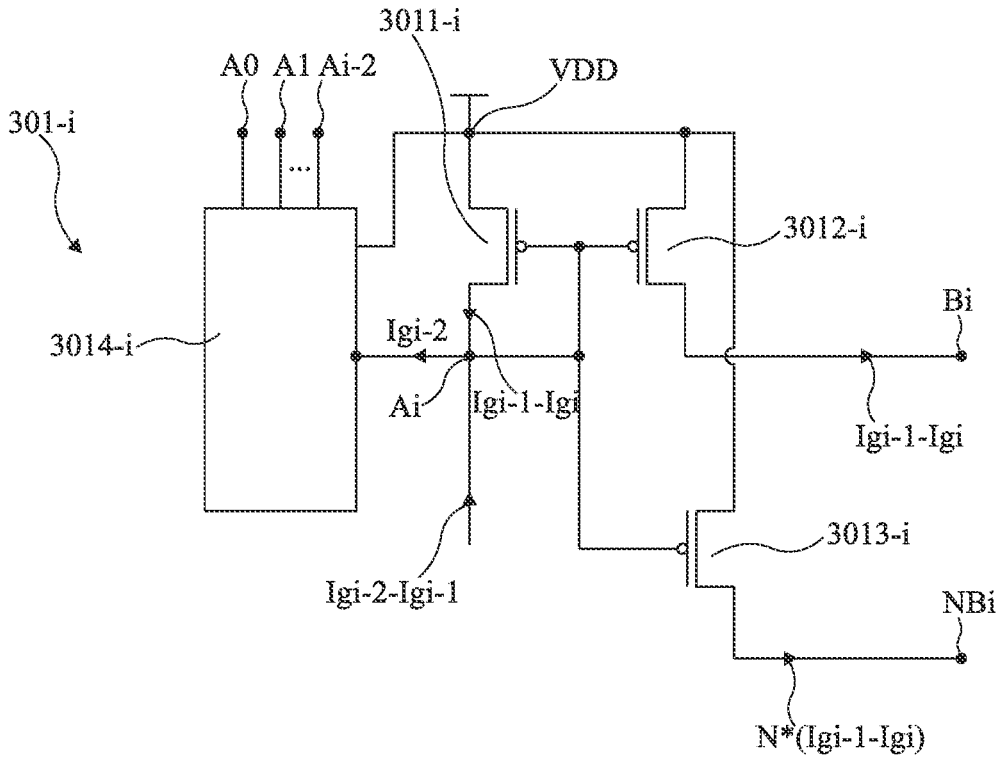
FIG. 6 shows a part of the embodiment of FIG. 5, schematically and partially in block form.

FIG. 6 illustrates a partial circuit diagram of an example embodiment of a circuit 301-*i* described in connection with FIG. 5.

As described in connection with FIG. 5, the circuit 301-*i* comprises the node Ai as an input node, and the nodes Bi and NBi as output nodes.

The circuit 301-*i* comprises a current mirror composed of two transistors, 3011-*i* and 3012-I, of the same type, the transistor 3011-*i* being diode connected. The sources of the transistors 3011-*i* and 3012-*i* are linked, preferably connected, to the node VDD. More particularly, the transistors 3011-*i* and 3012-*i* are of the same type as the transistors 201 and 202 described in connection with FIG. 5, and, preferably, the transistors 3011-*i* and 3012-*i* are preferably identical to the transistor 201. In FIG. 6, the transistors 3011-*i* and 3012-*i* are PMOS-type transistors. On its input node, the current mirror receives the node Ai, corresponding to the drain of the transistor 311-*i*, the current Igi−1, from which the parasitic current Igi of the circuit 301-*i*, noted (Igi−1)-(Igi), is subtracted. The current Igi corresponds here to the gate current of the transistor 3011-*i*. The current (Igi−1)-(Igi) flows from the drain of the transistor 3011-*i* to the node Ai. The output of the current mirror is the node Bi, which provides the copied current (Igi−1)-(Igi).

The circuit 301-*i* further comprises a transistor 3013-*i*, current mirrored with the transistor 3011-*i*. The transistor 3013-*i* is a transistor of the same type as the transistor 3011-*i*, such as a PMOS-type transistor. More particularly, the transistor 3013-*i* is identical to the transistor 202, and thus has a size coefficient relative to transistor 3011-*i* equal to the coefficient N of the transistors 201 and 202. The transistor 3013-*i* is current-mirrored with the transistor 3011-*i*. In other words, the gate of the transistor 3013-*i* is linked, preferably connected, to the node Ai, the source of the transistor 3013-*i* is linked, preferably connected, to the node VDD, and the drain of the transistor 3013-*i* is linked, preferably connected, to the node NBi. Thus, the node NBi provides a current given by the following formula:

$$N*[(Igi-1)-(Igi)]$$

The circuit 301-*i* comprises a module 3014-*i* adapted to contribute to the supply of the parasitic current of the preceding circuit 301-*i*−1 to the current mirror input, composed of the transistors 3011-*i* and 3012-*i*. More particularly, the module 3014-*i* is adapted to provide the current Igi−2 to the node Ai. An example embodiment of the module 301-*i* is described in connection with FIG. 7.

Figure 7:
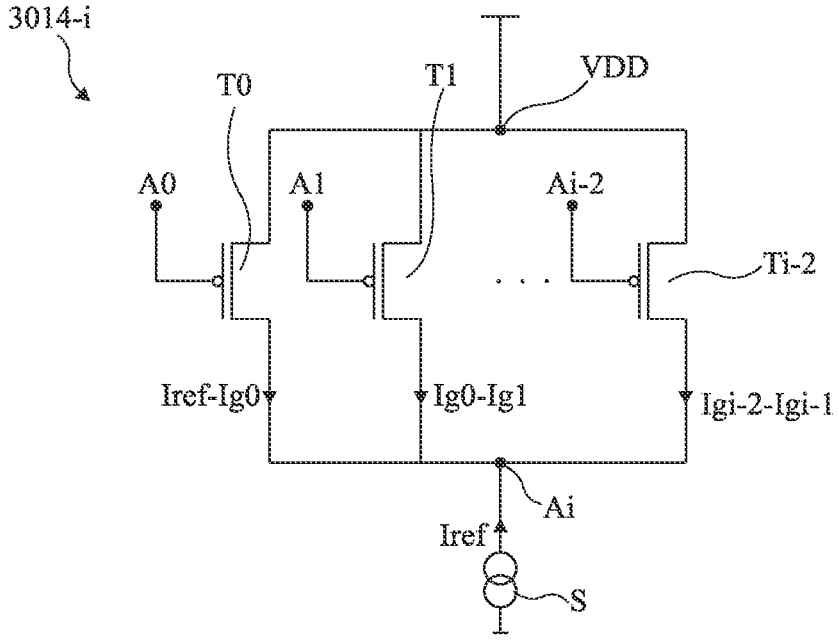
FIG. 7 shows in more detail a part of the embodiment of FIG. 5, in more detail.

FIG. 7 is a circuit diagram of an example embodiment of module 3014-*i* described in connection with FIG. 6.

The module 3014-*i* comprises i−1 transistors Tj, with j being an integer ranging from 0 to i−2, arranged in parallel between the nodes VDD and Ai. More particularly, the drains of the transistors Tj are linked, preferably connected, to the node Ai, and the sources of the transistors Tj are linked, preferably connected, to the node VDD. Each transistor Tj has its gate linked, preferably connected, to the node A0, . . . , Ai−2 of the preceding circuits 301-*i*. More particularly, the transistor T0 has its gate linked, preferably connected, to the node A0, the transistor Ti has its gate linked, preferably connected, to the node A1, and so on. In other words, each transistor Tj is current-mirrored with the transistor 3011-*j* of the circuit 301-*j* ranked j. The transistor Tj is of the same type as the transistor 201, in FIG. 6, the transistor Tj is a PMOS-type transistor. Thus, each transistor Tj provides a current Igj−2-Igj−1 on its drain, with the current Igj−2-Igj−1 flowing from the drain of the transistor Tj to the node Ai.

The module 3014-*i* further comprises a current source S adapted to provide the current Iref. More particularly, the current source S is adapted to supply this current Iref to the node Ai.

FIG. 8 is a circuit diagram of an example embodiment of a device 400, similar to a device 300, for which K is equal to two.

The device 400 comprises the two transistors 201 and 202 connected as a current mirror, wherein the transistor 201 is diode connected. This current mirror receives a current Iref at its input node, corresponding to the drain of transistor 201, supplied by current source 203.

The device 400 further comprises two circuits 301-1 and 301-2, delimited by dotted lines in FIG. 8.

The circuit 301-1 comprises the transistors 3011-1, 3012-1, 3013-1, and T0 and the current source S, arranged and connected as described in connection with FIGS. 6 and 7.

The circuit 301-2 comprises the transistors 3011-2, 3013-2, T0 and the current source S, arranged and connected as described in connection with FIGS. 6 and 7. The circuit 301-2 does not comprise an output node B2, and therefore does not comprise the transistor 3011-2.

Various embodiments and variants have been described. Those skilled in the art will understand that certain features of these embodiments can be combined and other variants will readily occur to those skilled in the art.

Finally, the practical implementation of the embodiments and variants described herein is within the capabilities of those skilled in the art based on the functional description provided hereinabove.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An electronic device comprising:

a first MOS-type transistor and a second MOS-type transistor connected as current mirrors, wherein the first transistor is diode connected; and a first circuit configured to provide a first current equal to a first gate current of the first transistor multiplied by a size ratio of the first and second transistors, wherein the first circuit comprises K second circuits arranged in a cascade, wherein K is a relative integer, wherein each second circuit is configured to isolate a parasitic current from a preceding circuit, and wherein a second circuit ranked i, with i varying from 1 to K, comprises an input node connected to an output node of a second circuit ranked i−1, a first output node connected to an input node of a second circuit ranked i+1, and a second output node connected to a second conduction terminal of the second transistor.

2. The device according to claim 1, wherein the first circuit is connected to a first node, interconnecting a first transistor gate of the first transistor and a second transistor gate of the second transistor, and wherein the first circuit is connected to a second node interconnecting a first conduction terminal of the first transistor and a first conduction terminal of the second transistor.

3. The device according to claim 2, wherein the first circuit is configured to provide the first current to a second conduction terminal of the second transistor.

4. The device according to claim 3, wherein the second node is configured to receive a supply voltage VDD.

5. The device according to claim 1, wherein the first and second transistors are P-t e MOS transistors.

6. The device according to claim 1, wherein the first circuit comprises a first module configured to isolate the first gate current and a first current mirror.

7. The device according to claim 6, wherein the first current mirror comprises third and fourth MOS transistors, the third transistor being diode connected, and wherein second gate currents of the second and third transistors are negligible in relation to the first gate current.

8. The device according to claim 7, wherein the third and fourth transistors are P-type MOS transistors having a double oxide layer.

9. The device according to claim 7, wherein the third and fourth transistors have a size ratio equal to the size ratio of the first and second transistors.

10. The device according to claim 6, wherein the first current mirror comprises fifth and sixth transistors, the fifth transistor being diode connected, and wherein a third gate current of the fifth transistor is proportional to the first gate current.

11. The device according to claim 10, wherein the third gate current is equal to half the first gate current, and wherein a size ratio of the fifth and sixth transistors is equal to twice the size ratio of the first and second transistors.

12. The device according to claim 1, wherein K is equal to 2.

13. The device according to claim 1, wherein K is equal to 3.

14. An electronic device comprising:

a first MOS-type transistor and a second MOS-type transistor connected as current mirrors, wherein the first transistor is diode connected; and a first circuit configured to provide a first current equal to a first gate current of the first transistor multiplied by a size ratio of the first and second transistors, wherein the first circuit comprises K second circuits arranged in a cascade, wherein K is a relative integer, wherein each second circuit is configured to isolate a parasitic current from a preceding circuit, and wherein each of the second circuits comprises:

a second current mirror comprising seventh MOS-type transistors of the same dimensions, a third current mirror comprising eighth MOS-type transistors whose size ratio is equal to the size ratio of the first and second transistors; and a second module configured to isolate a parasitic current from another of the second circuits.

15. The device according to claim 14, wherein the second module is connected to input nodes of the second circuits ranked between 1 and i–2, and to an interconnection node of the gates of the first and second transistors.

16. The device according to claim 14, wherein the second and third current mirrors share the same, ninth diode connected transistor.

17. The device according to claim 14, wherein the first circuit is connected to a first node, interconnecting a first transistor gate of the first transistor and a second transistor gate of the second transistor, and wherein the first circuit is connected to a second node interconnecting a first conduction terminal of the first transistor and a first conduction terminal of the second transistor.

18. The device according to claim 17, wherein the first circuit is configured to provide the first current to a second conduction terminal of the second transistor.

19. The device according to claim 18, wherein the second node is configured to receive a supply voltage VDD.

20. The device according to claim 14, wherein the first and second transistors are P-type MOS transistors.

* * * * *